United States Patent [19]

Olk

[11] Patent Number: 5,038,966

[45] Date of Patent: Aug. 13, 1991

[54] HOPPER DOOR CLOSURE

[75] Inventor: Cynthia A. Olk, Hortonville, Wis.

[73] Assignee: Tom-Cin Metals, Inc., Hortonville, Wis.

[21] Appl. No.: 405,643

[22] Filed: Sep. 11, 1989

[51] Int. Cl.[5] ..... B67D 3/00; B67D 5/06

[52] U.S. Cl. ..... 222/504; 222/561; 105/282.1; 105/282.3; 105/286

[58] Field of Search ..... 222/559, 561, 504; 105/282.2, 282.1, 282.3, 286, 305, 306, 307; 198/532; 414/291, 288, 293, 299; 298/24, 27, 28

[56] References Cited

U.S. PATENT DOCUMENTS 4,342,267 8/1982 Blout ..... 105/282.2
4,359,176 11/1982 Johnson ..... 222/561

FOREIGN PATENT DOCUMENTS 564137 3/1923 France ..... 414/288
99186 4/1938 Sweden ..... 414/288

*Primary Examiner*—Michael S. Huppert
*Assistant Examiner*—Kenneth Bomberg
*Attorney, Agent, or Firm*—Fuller, Ryan & Hohenfeldt

[57] ABSTRACT

A hopper which contains loose material, and a door and frame assembly for attachment to the bottom of the hopper, for controlling the flow of the loose material therefrom. The assembly includes a door frame formed of spaced side and end walls, and a cross-piece which, with the side walls and one of the end walls, defines a hopper outlet opening. A door is slidably mounted to the frame so as to be across the outlet opening when in a closed position and to be clear of the opening when in an open position. A door moving device is provided for sliding the door, with respect to the opening, between the closed position and the open position. The frame particularly includes structure for attaching a plurality of different types of door moving devices, including air or hydraulic cylinder arrangements, or rack-and-pinion arrangements operated by an electric motor, or by hand or by means of a chain or cable.

6 Claims, 2 Drawing Sheets

HOPPER DOOR CLOSURE

BACKGROUND OF THE INVENTION

This invention relates to hopper door assemblies for opening and closing openings in hoppers for particulate matter such as feed hoppers and in particular to such hopper door assemblies that are adaptable to a number of different types of hopper door controls.

In the past, it has been common for most hopper manufacturers to design a hopper door assembly for one particular type of closure apparatus, and therefore to design separate and different hopper door assemblies for the various different types of closure apparatus available. For instance, Blout, U.S. Pat. No. 4,342,267, shows a hopper door closure assembly that is opened and closed by turning a shaft, that shaft having thereon pinions which engage perforations forming a rack. As another example, Johnson, U.S. Pat. No. 4,359,176, shows a hopper door closure assembly wherein the door is closed by a power actuator cylinder.

The generally accepted idea in the industry, that separate models of doors are required to accommodate the different types of closures, requires the manufacturer and retailer to carry high numbers of inventory items. There is need in the market, then, for a hopper door closure assembly that is adaptable to a number of different types of closures, and which in addition is highly resistant to leaking dust from the assembled hopper into the surrounding air. Further, it is desirable to provide the capability to easily convert from one type of closure to another after installation of the hopper door and closure assembly.

This invention relates to improvements to the apparatus described above and to solutions to the problems raised or not solved thereby.

SUMMARY OF THE INVENTION

The invention includes a hopper which contains loose or particulate material, and a door and frame assembly for attachment to the bottom of the hopper, for controlling the flow of the loose material therefrom. The invention comprises a door frame formed of spaced side and front and rear walls defining a rectangular outlet opening. A door is slidably mounted to the frame so as to be across the opening when in a closed position and to be clear of the opening when in an open position. Door moving means are provided for sliding the door, with respect to the opening, between the closed position and the open position. The invention further includes attaching means for attaching to the frame a plurality of different types of sliding means. Generally the loose material will contain a substantial amount of undesirable dust. The attaching means therefore further comprises means for containing the dust within the frame while the loose material is being discharged from the hopper. In the most preferred embodiment the attaching means includes a plurality of apertures or partial cuts formed in the frame for attachment of those different types of sliding means, so that any apertures not used by the particular type of sliding means chosen remain closed.

Other objects and advantages of the invention will become apparent hereinafter.

DESCRIPTION OF THE PREFERRED EMBODIMENT

Figure 1:
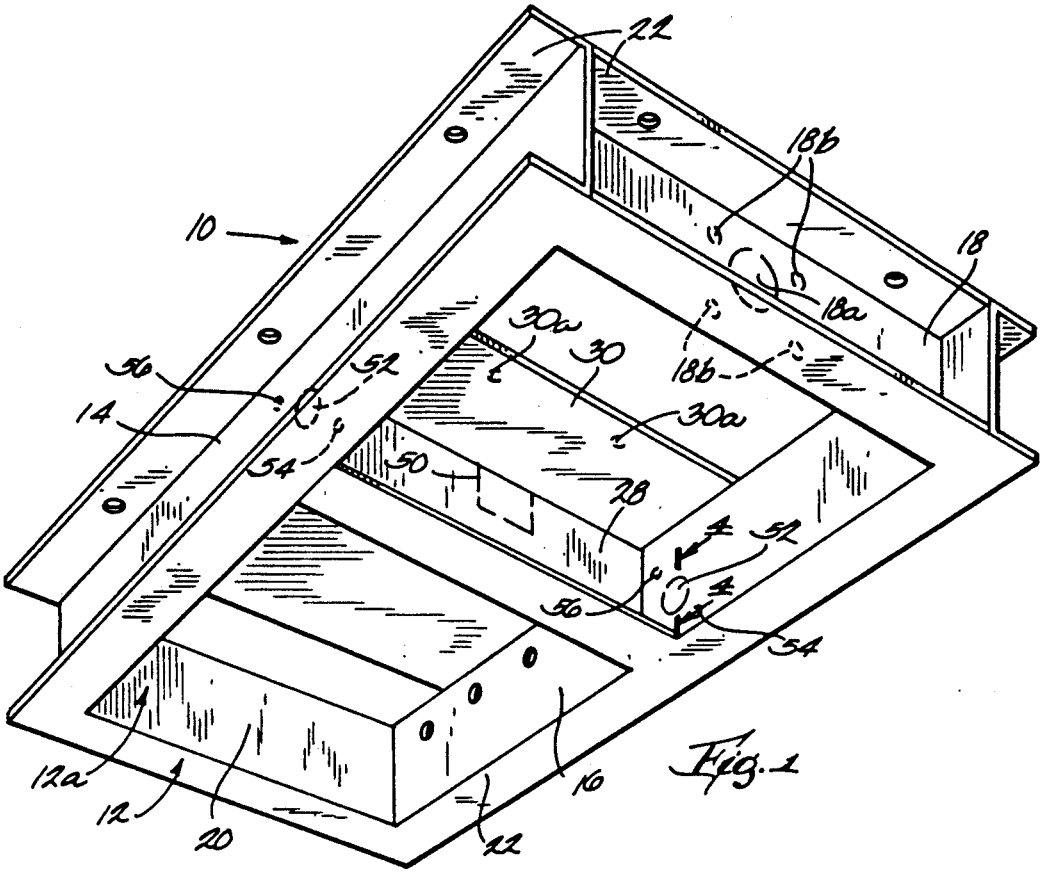
FIG. 1 is an isometric view from underneath to show detail, of a hopper door assembly constructed according to a preferred embodiment of the invention, having no means for moving the hopper door installed.

Referring now to FIG. 1, there is shown a hopper door assembly 10. As there shown, the assembly 10 includes a hopper door frame 12, which is formed of side walls 14 and 16, and end walls 18 and 20. Flanges 22 are provided to enhance the strength of the walls 14, 16, 18 and 20 and to facilitate attachment of the door frame 12 to a hopper 24, shown in FIGS. 2 and 3, such as by bolts 26. The hopper 24 will generally contain loose particulate matter such as cattle feed, granular fertilizer, building materials such as sand or gravel, or similar materials. The purpose of the hopper door assembly 10 is to control the flow of the particulate matter.

Figure 2:
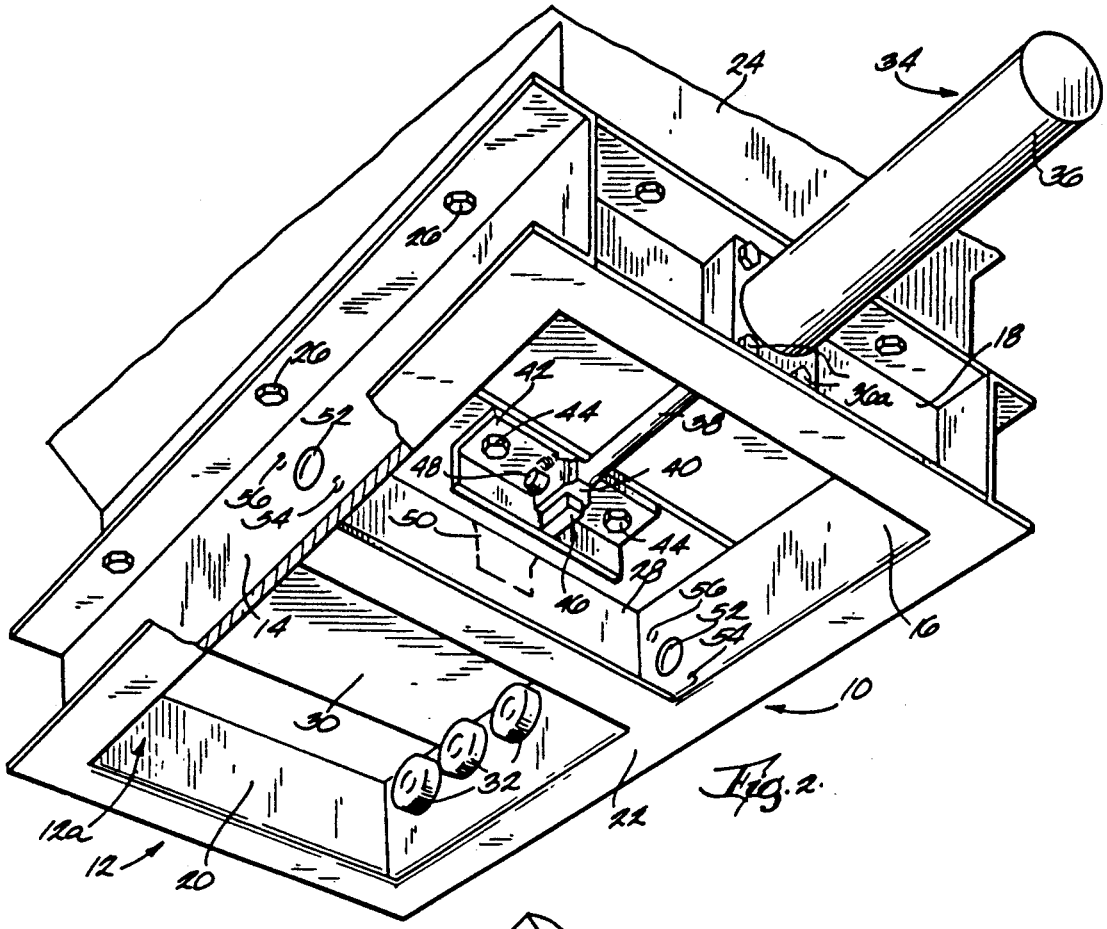
FIG. 2 is an isometric view, again from underneath, of the hopper door assembly shown in FIG. 1, having a power cylinder-type closure apparatus applied thereto.
Figure 3:
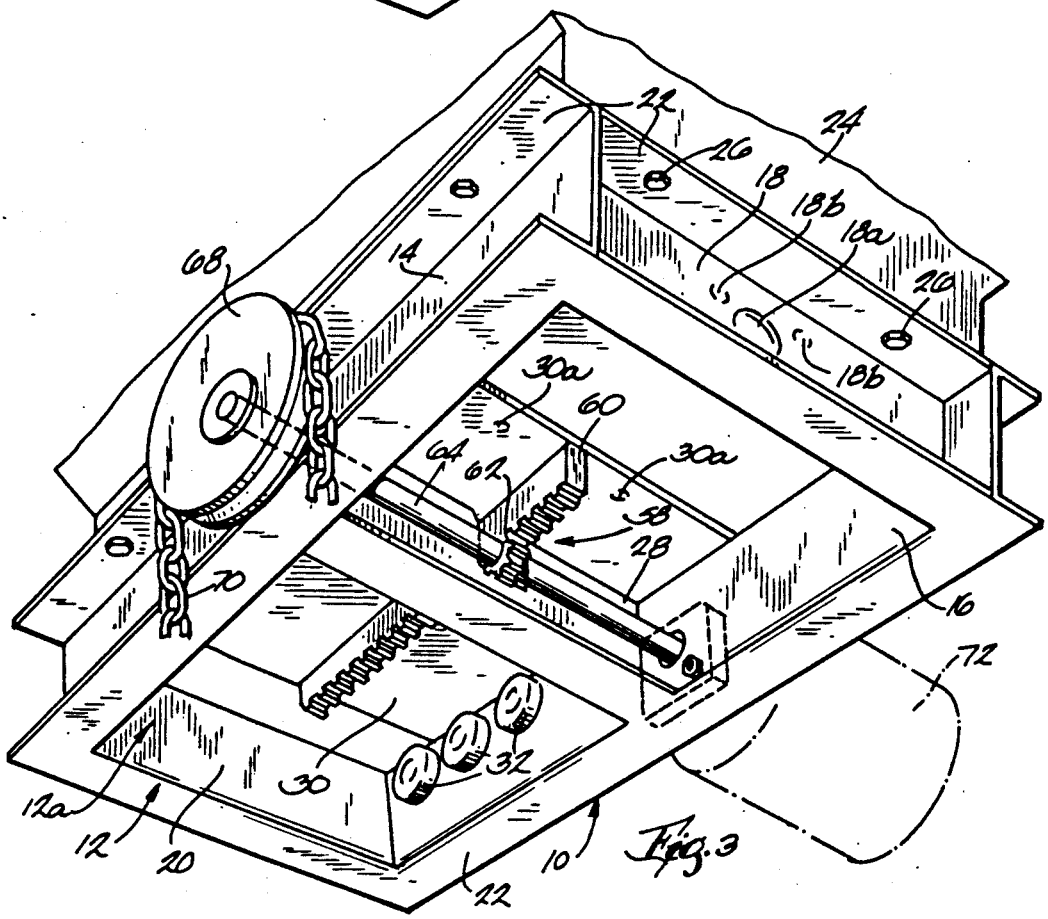
FIG. 3 is an isometric view, again from underneath, of the hopper door assembly shown in FIG. 1, having a rack and pinion-type closure apparatus applied thereto.

In the embodiment shown in FIG. 1, the door frame 12 is provided with a cross-piece 28 mounted or formed between and orthogonal to the side walls 14 and 16. Thus there is formed an opening 12*a* in the door frame between the side walls 14 and 16, one of the end walls 20 and the cross-piece 28. This opening 12*a* is controlled by a sliding door 30, which is slidable between a closed position, where the door is entirely across the opening, and an open position, where the door is entirely clear of the opening. Referring now to FIGS. 2 and 3, door moving means are provided to move the door 30 between its open position and its closed position, and possibly to one or more positions therebetween. As shown there, the frame 12 may be provided with means to facilitate the movement of the door 30 even though the load of the particulate matter in the hopper 24 is great. Such facilitation means may include rollers 32 which are rotatably connected to each side wall 14 and 16, and positioned so that their peripheries bear on the door 30 itself. Hence the door 30 provides control of the flow of the particulate matter referred to above.

An object of the present invention is to provide the hopper door assembly 10 with attaching means to attach a number of different types of door moving means. A number of cuts or partial punches are provided as shown in FIG. 1 to accommodate different door moving means. As shown in FIG. 1, there are formed near the center of the end wall 18 a large partial cut 18*a* and a number of smaller cuts 18*b*, all generally circular in shape. The smaller partial cuts 18*b* generally surround the larger partial cut 18*a*. There is also a pair of small holes 30*a* at the end of the door 30 nearest the end wall 18. These holes 30*a* need not be closed since they are positioned in a part of the door 30 that is never exposed to the material in the hopper 24. In addition, there is a rectangular cut 50 formed at the upper edge, at the center of the cross-piece 28, and a number of generally circular cuts 52, 54 and 56, one larger and the other two on a diagonal from the larger one, provided in side walls 14 and 16, just on the side of the cross-piece 28 nearer the end wall 18. All of these are provided so as to permit a number of different door moving means for controlling the movement of the door 30.

In FIG. 2, a linear actuator 34, such as an air cylinder or hydraulic cylinder, is provided as the door moving means to move the door 30 between its open and closed positions. As can there be seen, the actuator 34 includes a cylinder portion 36, which is attached to end wall 18, and a rod portion 38 which is caused to slide into and out of the cylinder portion. The rod 38 passes through partial cut 18*a*, which has been completely opened as part of the installation of the cylinder 36. The cylinder 36 is affixed to end wall 18 by means of bolts 36*a* which pass through the smaller partial cuts 18*b*, now also opened. The rod 38 terminates in a clevis 40. A mounting angle 42 is attached to the end of the door 30 nearest the end wall 18 by any suitable removable attachment means, such as bolts 44 which pass through holes 30*a*. The mounting angle 42 includes a projection 46 that projects away from the door 30, and fits into the clevis 40, held there by a bolt or pin 48. Hence when the cylinder 36 causes the rod 38 to move back and forth, the door 30 is opened and closed. The partial cuts 50, 52, 54 and 56 are not used to attach the actuator 34, and thus remain closed.

As shown in FIG. 3, a rack-and-pinion arrangement 58 is shown as the door moving means to move the door 30 between its open and closed positions. This arrangement 58 includes a gear rack 60 attached to the door 30 itself, extending generally parallel to the side walls 14 and 16, and running substantially the length of the door. The rack 60 thus passes through the cross-piece 28, after the partial cut 50 is opened. A pinion gear 62 is affixed to a shaft 64, which shaft projects through and is journaled to the side walls 14 and 16 by means of bearings 66 bolted to the side walls by one or more bolts 67. The shaft 64 itself passes through the larger partial cut 52 once opened, and the bolts holding the bearings 66 in place pass through the smaller cuts 54 and 56, once opened. Means for rotating the shaft 64 is provided, which in turn causes the pinion gear 62 to turn, moving the door 30 open or closed via rack 60. In the embodiment shown in solid lines in FIG. 3, the means for rotating the shaft 64 is a chain wheel 68 affixed to one end of the shaft 64, which is rotated by an operator pulling on a chain 70. Alternatively, as shown in phantom in FIG. 2, a motor 72 could be connected to the shaft 64, thereby causing the shaft to turn as described above. The partial cuts 18*a* and 18*b* remain closed as unused.

Figure 4:
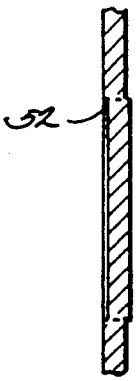
FIG. 4 is a cross sectional view of a wall of FIG. 1, taken along line 4—4 of FIG. 1.
Figure 5:
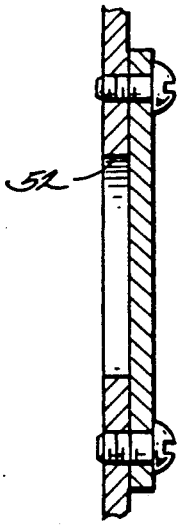
FIG. 5 is a cross sectional view similar to FIG. 4, wherein the punch-out has been removed and reclosed by other closure means.

Hence a single frame 12 is provided, including means for accepting a number of different means for moving the hopper door. The invention thus provides an inexpensive assembly which is easily adapted to accept different types of closure means. Retailers are thus relieved of the burden and expense of carrying a large number of inventory items to accommodate the needs and desires of different purchasers. In addition, generally the particulate material contained in the hopper will contain a substantial amount of undesirable dust. It is therefore important that the dust be contained within the hopper area defined by the hopper, the frame, and the vessel into which the particulate material is being discharged. The partial cuts which are not removed, such as that shown in FIG. 4, achieve the valuable function of containing this dust within this case, making for a safer working environment for any workers who are employed in proximity to the hopper. As to those partial cuts already removed and no longer filled due to a change in the door moving means, closure means, such as grommets or closure plates 74, FIG. 5, may be provided to again close those apertures formed in the earlier installation, such as by being bolted in.

While the apparatus hereinbefore described is effectively adapted to fulfill the aforesaid objects, it is to be understood that the invention is not intended to be limited to the specific preferred embodiment of hopper door closure set forth above. Rather, it is to be taken as including all reasonable equivalents within the scope of the following claims.

I claim:

1. A hopper door and frame assembly for attachment to the bottom of a hopper, said hopper containing loose material, and for controlling the flow of said loose material therefrom, comprising:

a door frame formed of side walls spaced apart and intersecting end walls also spaced apart, and including a cross-piece which, in combination with said two side walls and one of said end walls defines a rectangular outlet opening;

a door slidably mounted to said frame so as to be across said opening when in a closed position and to be clear of said opening when in an open position;

door moving means for sliding said door, with respect to said opening, between said closed position and said open position; and attaching means for attaching to said frame a plurality of different types of said door moving means having different form factors, said attaching means including a plurality of sets of apertures formed in said frame for attachment of said different types of said door moving means.

2. An assembly as recited in claim 1 wherein said loose material contains a substantial amount of undesirable dust, and wherein said attaching means further comprises means for containing said dust within an area defined by said hopper, said frame, and any vessel into which said loose material is being discharged.

3. An assembly as recited in claim 2 wherein said attaching means includes means for maintaining closed any apertures not used by the particular type of door moving means chosen.

4. An assembly as recited in claim 3 wherein said maintaining means includes the apertures being formed by only partially punching out portions of the frame, and not completely removing those portions.

5. An assembly as recited in claim 3 wherein said maintaining means includes closure plates, removably attached over any apertures already opened, for closing those apertures.

6. An assembly as recited in claim 4 wherein said maintaining means further includes closure plates, removably attached over any apertures already opened, for closing those apertures.

* * * * *